United States Patent [19]

Grahm

[11] Patent Number: 4,672,743

[45] Date of Patent: Jun. 16, 1987

[54] FOLDING HAND KNIFE

[76] Inventor: Robert D. Grahm, 10115 Bridlevale Dr., Los Angeles, Calif. 90064

[21] Appl. No.: 906,987

[22] Filed: Sep. 15, 1986

[51] Int. Cl.[4] ..... B26B 29/02

[52] U.S. Cl. ..... 30/153

[58] Field of Search ..... 30/153, 255

[56] References Cited

U.S. PATENT DOCUMENTS

| | | | |
|---|---|---|---|
| 881,294 | 3/1908 | Billings | 30/153 |
| 1,556,788 | 10/1925 | Hallvarson | 30/153 X |
| 2,714,249 | 8/1955 | Clark | 30/153 |
| 2,820,291 | 1/1958 | Philippar | 30/153 |
| 4,047,298 | 9/1977 | Philippar | 30/153 |
| 4,330,937 | 5/1982 | Cope | 30/153 |
| 4,364,174 | 12/1982 | De Asis | 30/153 |
| 4,547,965 | 10/1985 | Moore | 30/153 |
| 4,555,822 | 12/1985 | Miceli | 30/153 |

*Primary Examiner*—Jimmy C. Peters

*Attorney, Agent, or Firm*—Michael Bak-Boychuk

[57] ABSTRACT

A folding tool assembly including two C-shaped handle pieces pivotally engaged to the end of the tool to fold-over onto the tool in one pivotal limit or to fold against each other at the other limit to expose the tool. The pivotal end of the tool includes a cam surface opposed by springs from each handle piece including distentions in the surface for preferred spring alignment. Additionally, the pivotal end of each piece is shaped to oppose the other unless displaced in pivotal engagement along a slot.

6 Claims, 5 Drawing Figures

FOLDING HAND KNIFE

BACKGROUND OF THE INVENTION

1. Field of the Invention

The present invention relates to folding hand tools and more particularly to tools provided with a handle in which the tool end is stored.

2. Description of the Prior Art

Folding tools and collapsible manual devices have been known in the past. Best known amongst these is the folding pocket knife which often includes a variety of deployable tool ends all stored in a common handle. While the folding pocket knife has gone through an extensive evolution the hinge mechanism, nonetheless, requires stiff and closely fitting spring elements in order to oppose the collapse of the deployed tool blades. Consequently, relatively expensive manufacturing and assembly techniques are involved which result in a costly article.

An alternative to the folding pocket knife is a folding arrangement known commonly as the "butterfly knife". This configuration is characterized by a split handle structure comprising two longitudinal halves each fixed by its own pivot to the tool blade. Thus, each handle half is pivoted from an alignment over the blade to an alignment exposing the blade and when both halves are thus pivoted the blade end is fully exposed for use. While this folding arrangement offers manufacturing convenience some looseness in the blade connection is inherent with a consequent loss of tactile perception of incipient blade collapse.

A technique which obtains the manufacturing convenience of a "butterfly" folding arrangement without the incident blade looseness is desired and it is one such technique that is disclosed herein.

SUMMARY OF THE INVENTION

Accordingly, it is the general purpose and object of the present invention to provide a folding tool arrangement which is convenient in manufacture.

Other objects of the invention are to provide a folding tool in which two halves of a handle collapse onto the tool blade in a predetermined sequence.

Yet further objects of the invention are to provide a collapsible tool assembly in which the tool blade is locked upon the unfolding of the halves of the handle.

Briefly, these and other objects are accomplished within the present invention by providing a folding tool assembly in which a handle is formed in two recessed halves or sections each slidably pivoted from a corresponding pivot pin at the end of a tool blade. The pivotal motion of the handle section is confined by inclined pivot slots engaging the pivot pins in a sliding displacement determined by a cam surface at the pivot end of the tool blade. Thus, when the handle sections are turned to expose the blade the inclination of the slots drives the pivotal ends into opposition. The opposed shape of each handle section body around the pivot then precludes inadvertent collapse of the blade.

The cam surface at the pivotal end of the tool blade abuts spring tabs extending from each handle section which engage a common depression therein when fully deployed. At the same time the cam surface includes enlargements at the lateral edges thereof over which the tabs are urged to deform in the course of intentional folding. Moreover, the cam surface may include a geometrical preference whereby the handle section covering the sharp edge of the blade must first be collapsed before the other section is released for folding.

Of course the foregoing arrangement may further include a reversible clasp at the free ends of the sections and locating pins for locking the blade once deployed.

DESCRIPTION OF THE PREFERRED EMBODIMENT

Figure 1:
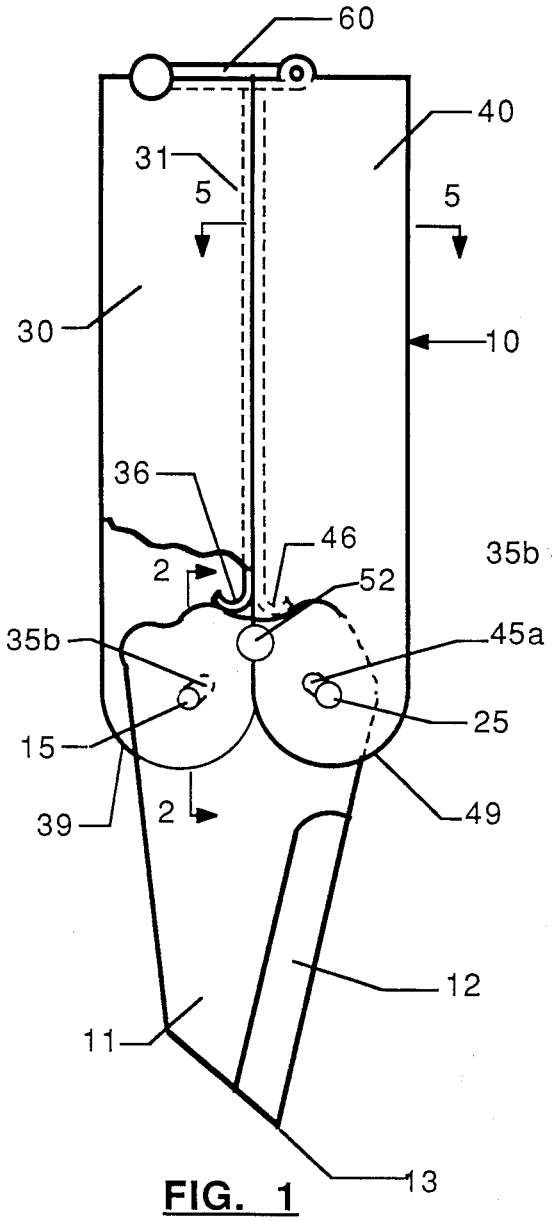
FIG. 1 is a side view in partial section of the inventive folding tool in its unfolded state.
Figure 2:
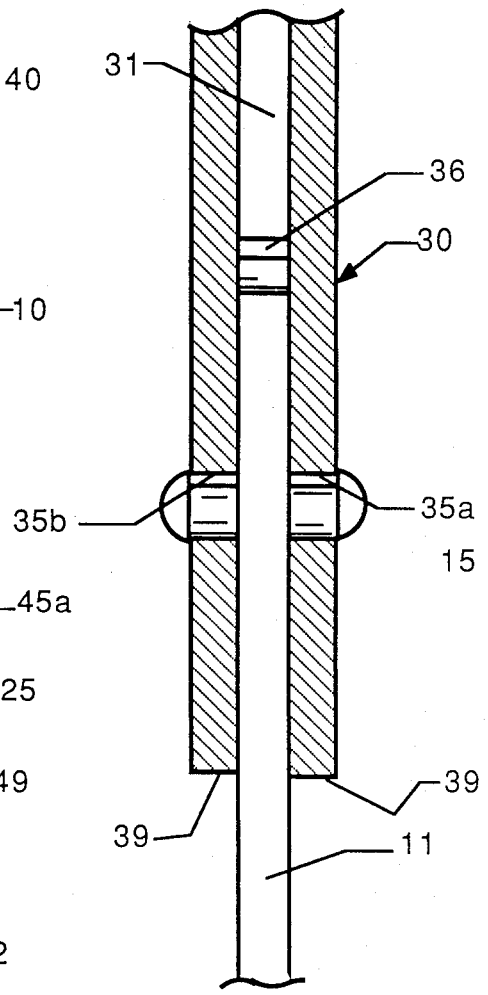
FIG. 2 is a sectional view taken along line 2—2 of FIG. 1.
Figure 5:
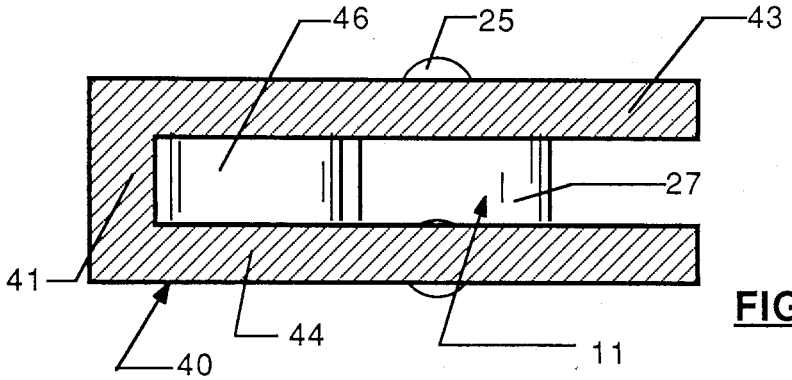
FIG. 5 is a sectional view taken along line 5—5 of FIG. 3.
Figure 3:
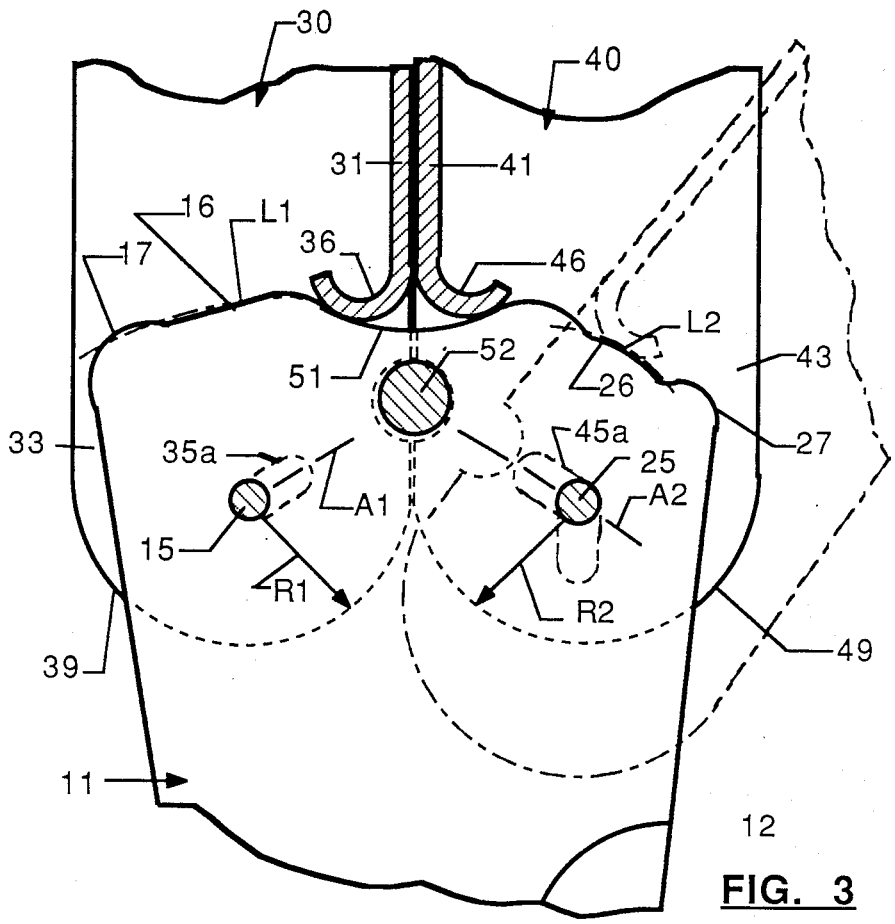
FIG. 3 is a geometric diagram of the folding sequence and the dimensional effects resulting therefrom.
Figure 4:
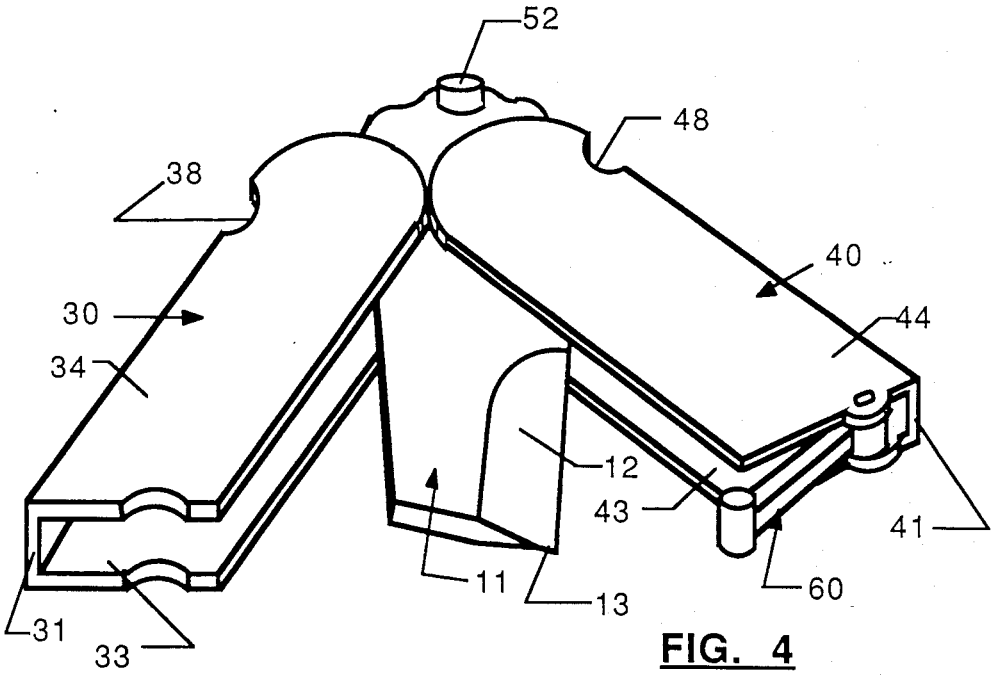
FIG. 4 is a perspective illustration of the inventive folding tool in a substantially collapsed state.

As shown in FIGS. 1–4 the inventive folding tool assembly generally designated by the numeral 10 comprises an elongate tool blade 11 which in the case of a cutting tool is formed from sheet metal stock ground to include a cutting edge 12 along one lateral boundary thereof. As in most typical cutting tools blade 11 may terminate at one end in a sharp point 13 and in this form accommodates all the puncturing and cutting functions of conventional devices. Proximate the other end blade 11 is pierced to receive in fixed engagement two laterally displaced pivot pins 15 and 25 each extending orthogonally beyond both sides of the blade.

The projecting ends of pin 15 each extend into corresponding inclined slots 35*a* and 35*b* in opposed surfaces 33 and 34 of a handle section 30 formed by folding around a spine segment 31 a sheet metal piece. Thus the handle section 30 pivots around pin 15 and concurrently is free to translate within the confines of slots 35*a* and 35*b*.

In a similar manner a second handle section 40 receives pin 25 within inclined slots 45*a* and 45*b* formed in opposed surfaces 43 and 44 extending from a spine segment 41.

The pivotal connection of sections 30 and 40 is such that upon exposure of blade 11 spine segments 31 and 41 align adjacent each other. Moreover, the end of each spine segment adjacent the pivot is notched along the fold lines to extend as free tabs 36 and 46 curled inwardly into the interior of each section to form cantelevered, spring-like loops therein. The looped and cantelevered tabs 36 and 46 compress against the edge of blade 11 which is shaped in the manner of a cam surface, tab 36 opposing surface segment 16 while comprising substantially one half of the end edge while tab 46 opposes the other half shown as surface segment 26. At their juncture surface segments 36 and 46 form a common depression 51 into which both tabs descend upon the full unfolding of the handle sections to expose blade 11. Additionally the surface segment 16 beyond depression 51 follows a locus L1 of equal or just slightly increasing radii from the longitudinal axis A1 of slots 35*a* and *b* to a curved enlargement 17 over which the tab 36 must pass in the course of pivotal closure. Surface segment 26, in turn, follows a locus L2 of just slightly decreasing radii from the longitudinal axis A2 of slots 45*a* and 45*b* to a surface enlargement 27. Axes A1 and A2 extend at an approximately 45 degree angle towards the spine segments 31 and 41.

Fixed to blade 11 in transverse alignment subjacent depression 51 is a locating post 52 aligned for receipt into notches 38 and 48 formed respectively in sections 30 and 40 subjacent tabs 36 and 46. Moreover, the free ends of sections 30 and 40 are provided with a latching apparatus 60 and thus may be latched together either when fully open or fully closed.

Thus, when the handle sections are fully opened with tabs 36 and 46 descended into depressions 51 the blade alignment is fixed by post 52. Upon folding section 40 will release first and since locus L2 follows a decreasing radius pin 25 can displace upwardly in slots 45*a* and 45*b*. This upward and outward displacement separates the pivoted end of section 40, shaped substantially as a circular edge 49 around the bottom of slots 45*a* and 45*b*, from a similarly shaped edge 39 at the pivoted end of section 30. Once thus separated edge 49 is brought out of interference with edge 39 and will thus permit full closure of section 40 into the cutting edge of blade 11.

It should be noted that the spring compression of tabs 36 and 46 against the cam edges of blade 11 drives the pivot pins 15 and 25 towards the lower limits of slots 35*a* and 35*b* and 45*a* and 45*b*. By selecting a dimension D between pins 15 and 25 which is slightly less than the sum of the radii R1 and R2 of the edge surfaces 39 and 49 the pins will not bottom fully in the slots. Accordingly, an interference between edges 39 and 49 will result which shall oppose inadvertent folding of the handle sections. Once section 40, however, is forced to pass beyond the point of intereference the incline of slots 45*a* and 45*b* allows for further folding which then fully releases section 30. Thus any inadvertent opening of clasp 60 will not immediately result in pivotal motion of the blade and as long as the sections are grasped together the blade may be safely used. The same restraints that control inadvertent opening also maintain the assembly folded thus shielding the user from injury when the device is carried on his person.

Obviously many modifications and changes may be made in the foregoing description without departing from the spirit of the invention. It is therefore intended that the scope of the invention be determined solely on the claims appended hereto.

What is claimed is:

1. A folding tool assembly comprising:

a. a tool element having a working end and a pivotal end;

b. a first elongate handle piece having a first upper and lower end and generally formed in the manner of a folded-over sheet structure including one longitudinal fold edge extending between said first upper and lower ends joining two opposed first planar surfaces separated by a gap, each first surface including a first semicircular edge proximate said first lower end;

c. a second elongate handle piece having a second upper and lower end and generally formed in the manner of a folded-over sheet structure including one longitudinal fold edge extending between said second upper and lower ends joining two opposed second planar surfaces separated by a gap, each said second surface including a second semicircular edge proximate said second lower end;

d. a first and second pivot pin extending orthogonally across said tool element laterally spaced relative each other in said working end of said tool element;

e. a first and second inclined slot formed in said first and second inclined surfaces each aligned from a point substantially central to said first and second circular edges towards the corresponding one of said fold edges, said first and second handle pieces receiving said tool element in said gaps thereof for receiving said first and second pivot pin in the corresponding one of said first and second slots;

f. a cam edge formed on the exterior of said pivotal end including a first cam edge segment proximate said first pivot pin substantially defined by a first radius relative thereto and a second cam edge segment proximate said second pivot pin substantially defined by a second radius relative thereto said first radius having a dimension greater than said second radius; and g. a first and second spring means respectively extending from said fold edges of said first and second handle pieces proximate the lower ends thereof and deployed or urging contact against the respective ones of said first and second cam edge segments.

2. Apparatus in accordance with claim 1 further comprising:

a cam edge depression formed in said cam edge between said first and second cam edge segments for receiving said first and second spring means therein.

3. Apparatus in accordance with claim 2 wherein:

said first and second handle pieces are engaged to said first and second pivot pins to present said fold edges thereof against each other upon receipt of said first and second spring means in said depression.

4. Apparatus according to claim 3 further comprising:

locating means formed on said tool element for engagement between said first and second handle piece.

5. Apparatus according to claim 4 further including:

clasp means engageable between said upper ends of said first and second handle piece.

6. Apparatus according to claim 1 wherein:

said first and second circular edges are of a radial dimension selected to interfere with each other upon the concurrent pivotal motion of said first and second handle piece.

* * * * *